US006371792B2

(12) United States Patent
Aoyama et al.

(10) Patent No.: US 6,371,792 B2
(45) Date of Patent: Apr. 16, 2002

(54) INSULATION-DISPLACEMENT TERMINAL FITTING

(75) Inventors: Masahiko Aoyama; Eiji Kojima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/885,875

(22) Filed: Jun. 20, 2001

(30) Foreign Application Priority Data

Jun. 29, 2000 (JP) ..... 2000-196446

(51) Int. Cl.[7] ..... H01R 4/24

(52) U.S. Cl. ..... 439/397; 439/400; 439/406; 439/398

(58) Field of Search ..... 439/401, 406, 439/407, 400, 379, 397, 398, 399, 395

(56) References Cited

U.S. PATENT DOCUMENTS 5,934,928 A * 8/1999 Endo et al. ..... 439/397

FOREIGN PATENT DOCUMENTS

| | | |
|---|---|---|
| DE | 7212035 | 6/1972 |
| EP | 0 352 966 | 1/1990 |
| EP | 0 352 966 B1 | 10/1993 |
| EP | 0 722 197 A2 | 7/1996 |
| GB | 1 490 197 | 10/1977 |
| JP | 08241740 | 9/1996 |

* cited by examiner

*Primary Examiner*—Tho D. Ta
(74) *Attorney, Agent, or Firm*—Anthony J. Casella; Gerald E. Hespos

(57) ABSTRACT

An insulation-displacement terminal (T) includes opposed side walls (12) and a wire-receiving space therebetween. Insulation-displacement portions (17) project from the side walls (12) and into the wire-receiving space. Each insulation-displacement portion (17) has two bases (18) that project from longitudinally spaced positions on the corresponding side wall (12). A blade (19) has two panels folded from the respective bases (18) and projecting further into the wire-receiving space. The folded blades (19) cut sharply into the resin coating (Wa) of a wire (W) urged into the wire-receiving space, and the bases (19) resist pulling forces on the wire (W). Therefore, a loose movement of the wire (W) in its longitudinal direction can be prevented.

19 Claims, 7 Drawing Sheets

(A)

(B)

(A)

(B)

(A)

(B)

INSULATION-DISPLACEMENT TERMINAL FITTING

BACKGROUND OF THE INVENTION

1. Field of the Invention.

The present invention relates to an insulation-displacement terminal fitting.

2. Description of the Related Art.

A known insulation-displacement terminal fitting is disclosed in published European Patent Appl. No. EP 0 722 197 A2 and has opposed first and second side walls with a wire receiving space therebetween. First and second insulation-displacement portions project from the respective first and second side walls and into the wire-receiving space. The known insulation-displacement terminal fitting is used with a wire that has a conductive core surrounded by a resin coating. The wire can be pushed normal to its longitudinal direction and into the wire-receiving space. As a result, the insulation-displacement portions cut open the resin coating and contact the core of the wire.

The insulation-displacement portions disclosed in the above-referenced EP 0 722 197 A2 are formed by bending or embossing portions of the side walls into a V-shape or triangular shape when viewed in a wire pushing direction. Thus, a pulling force in the longitudinal direction of the connected wire does not deform the blades of the insulation-displacement portions, and a loose movement of the wire in the longitudinal direction can be prevented.

However, V-shaped insulation-displacement portions contact the resin coating over a larger area than an insulation-displacement portion that is in the form of a single plate. Thus, it is more difficult to cut open the resin coating with a V-shaped insulation-displacement portion. A resin coating that is not cut open may be hooked on the insulation-displacement portions and may be stretched elastically as the core is inserted between the insulation-displacement portions. Elastic restoring forces of the stretched resin coating will urge the wire in a direction to withdraw the core from the clearance between the insulation-displacement portions. Alternatively, a resin coating that is not cut may be pushed between the insulation-displacement portions together with the core. Accordingly, the resin coating may prevent the core from properly contacting the insulation-displacement portions.

In view of the above, an object of the present invention is to provide an insulation-displacement terminal fitting with insulation-displacement portions that can restrict a loose movement of a wire in its longitudinal direction and securely cut open a coating of the wire.

SUMMARY OF THE INVENTION

The invention is directed to an insulation-displacement terminal fitting with first and second opposed side walls and a wire-receiving space therebetween. At least first and second insulation-displacement portions project into the wire-receiving space from the respective first and second side walls. A wire can be pushed transversely into the wire-receiving space. Thus, the insulation-displacement portions cut the resin coating of the wire and contact the core of the wire.

Each insulation-displacement portion comprises two longitudinally spaced bases formed by bending or embossing the corresponding side wall inwardly. Each insulation-displacement portion further comprises a blade formed by folding and projecting portions of the side walls further inwardly from the bases. The insulation-displacement portions are configured and dimensioned so that only the blades bite into the resin coating. The bases of each insulation displacement portion may project and converge in a V-shape from the side walls when viewed in the wire pushing direction, and thus the bases restrict pulling or pushing forces on the wire.

In one embodiment, the bases may be L-shaped when viewed in the wire pushing direction. In other embodiments, the bases may be arcuate when viewed in the wire pushing direction. For example, the bases may have concave surfaces that face into the wire receiving space, and hence the bases may be configured to bulge arcuately in directions closer to each other. Alternatively, the bases may have convex surfaces that face into the wire-receiving space, and hence the bases may be arcuately configured to bulge away from each other.

Blades formed by folding a pair of blade panels are brought sharply into contact with the resin coating when the wire is pushed between the insulation-displacement portions. As a result, the resin coating is cut open reliably and with relative ease. Longitudinal pushing or pulling forces on the wire after connection with the insulation-displacement portions are restricted by the bases that project from the side walls in two positions. Thus, loose movement of the wire in its longitudinal direction can be prevented.

Only the narrow folded blade panels are brought sharply brought into contact with the resin coating while the wire is being pushed between the insulation-displacement portions. Thus, a contact error resulting from the coating getting caught or hooked by the wide bases can be avoided.

DETAILED DESCRIPTION OF THE PREFERRED EMBODIMENTS

Figure 1:
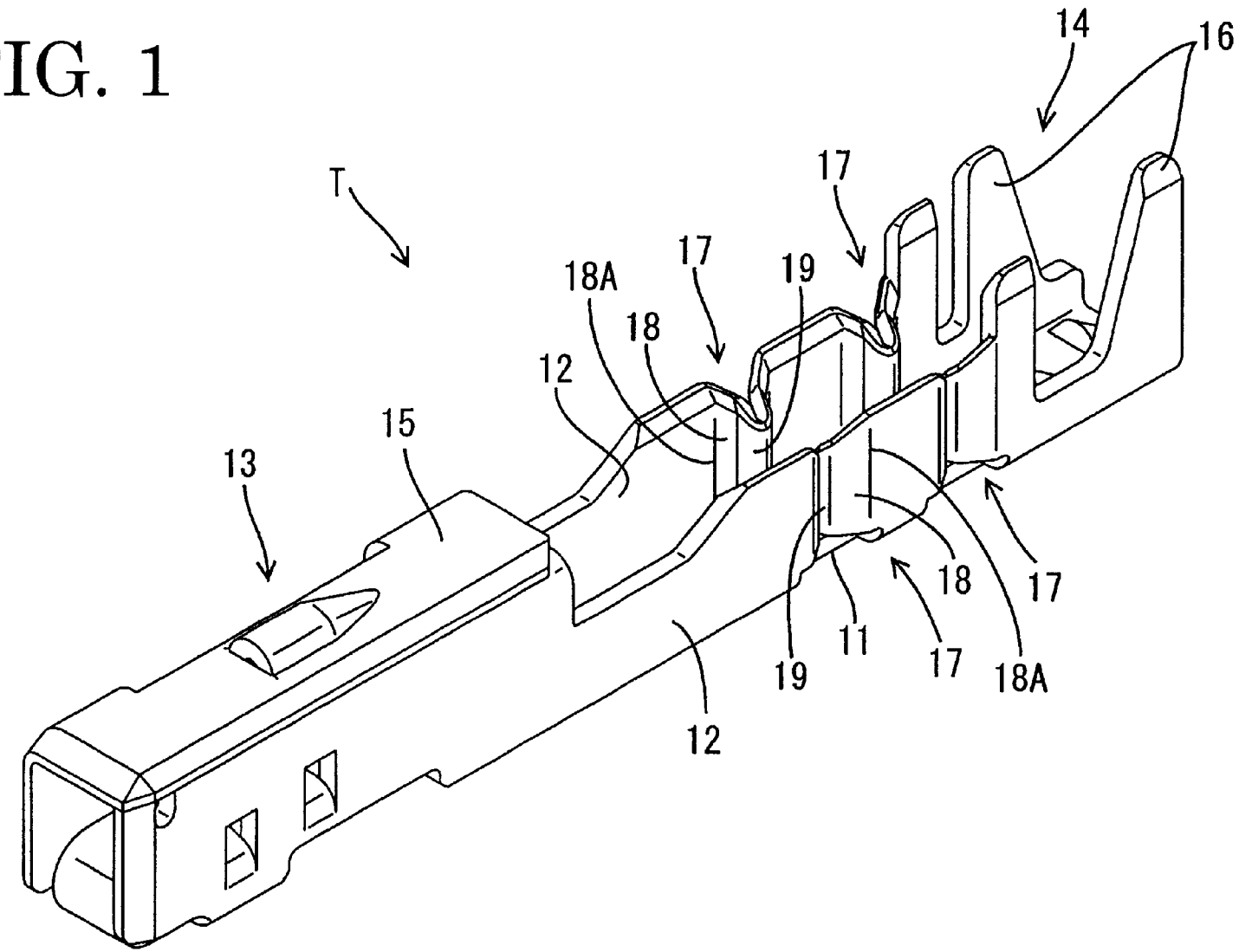
FIG. 1 is a perspective view of a first embodiment.
Figure 2:
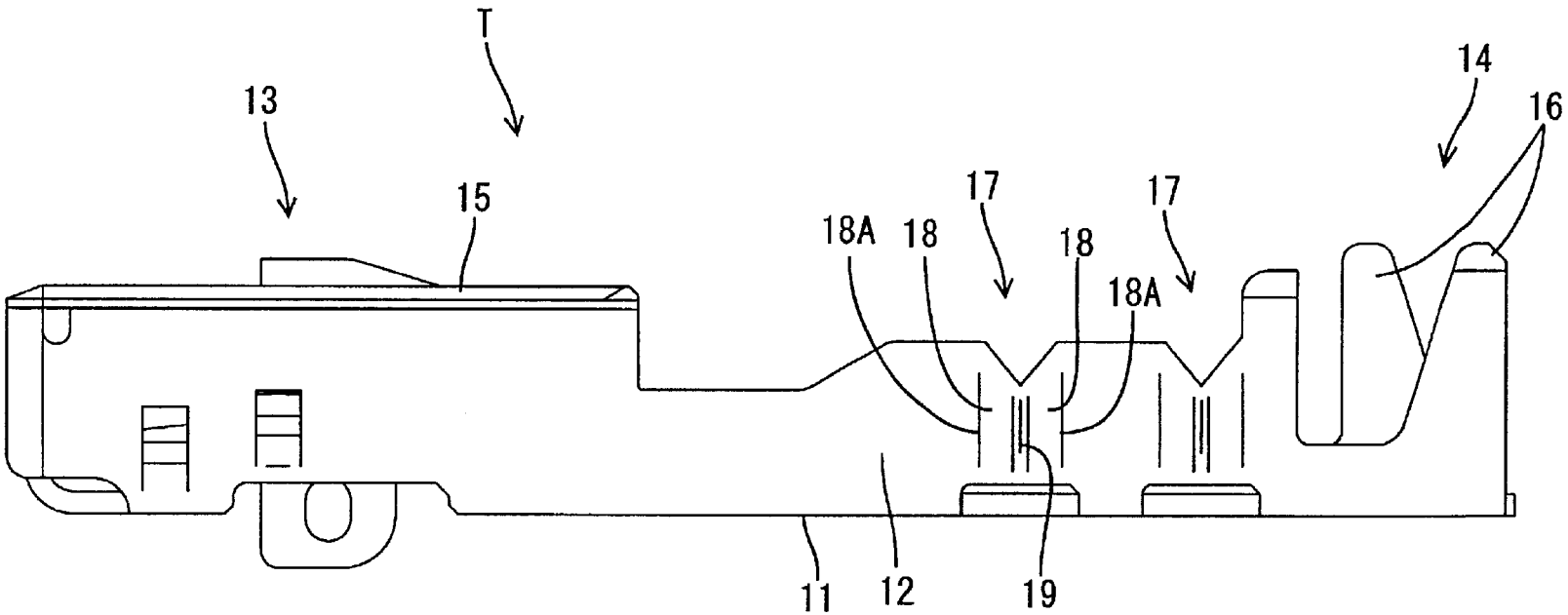
FIG. 2 is a side view of the first embodiment.
Figure 3:
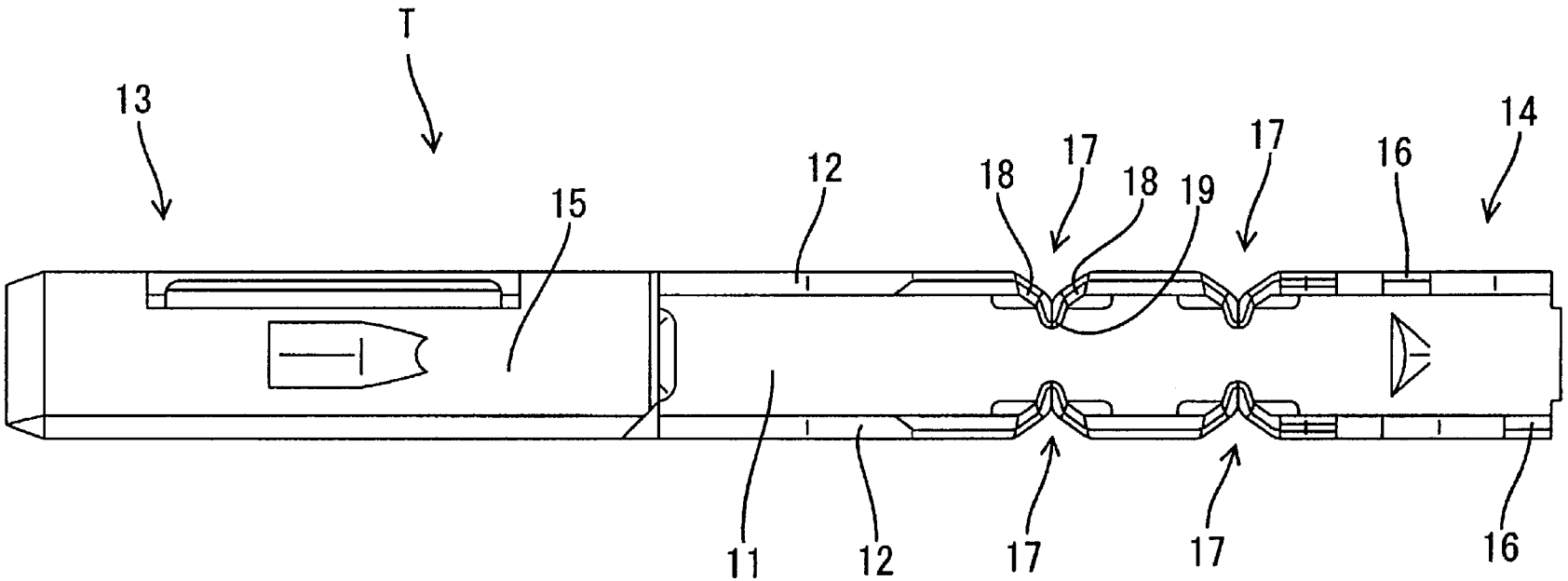
FIG. 3 is a plan view of the first embodiment.
Figure 4:
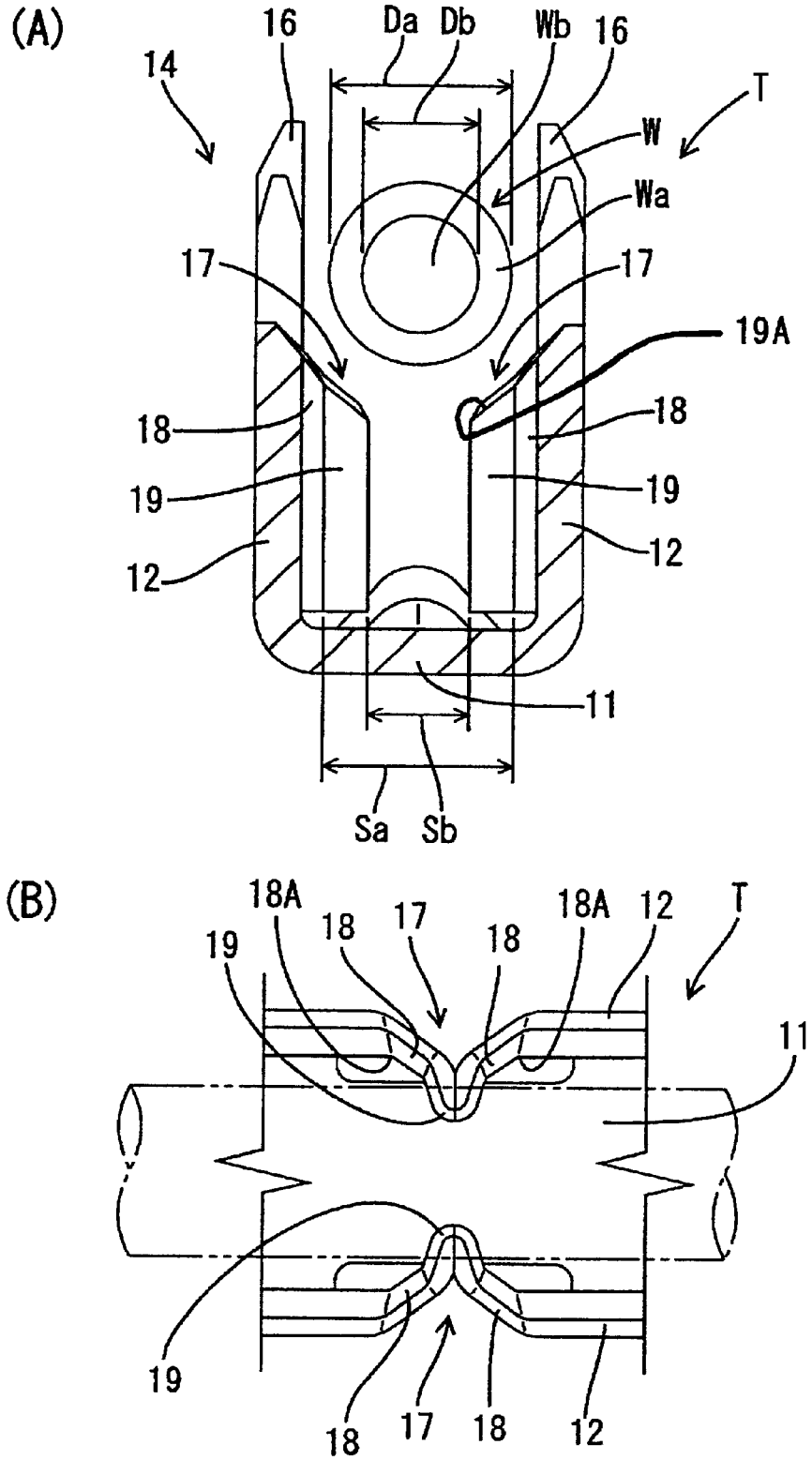
FIGS. 4(A) and 4(B) are an enlarged lateral section and an enlarged partial plan view showing insulation-displacement portions, respectively.

An insulation-displacement terminal fitting according to a first embodiment is of the invention is identified by the letter T in FIGS. 1–4. The insulation-displacement terminal fitting T is produced by bending and embossing a conductive metallic plate material that has been stamped into a specified shape. The insulation-displacement terminal fitting T has a bottom wall 11 that is narrow in forward and backward directions. First and second side walls 12 extend up from opposite side edges of the bottom wall 11 to define a wire-receiving space therebetween. An engaging portion 13 is formed at the front end of the terminal fitting T for connection with a mating male terminal fitting (not shown), and a crimping portion 14 is formed at the rear end of the terminal fitting T for crimped connection with a wire W.

Insulation-displacement portions 17 are formed before the crimping portion 14 and are configured for connection with the W, as explained below.

The engaging portion 13 is a rectangular tube that extends in forward and backward directions. More particularly, the engaging portion 13 is comprised of the bottom wall 11, the side walls 12 and overlapping ceiling walls 15 that extend inwardly from the upper edges of the side walls 12.

The crimping portion 14 is comprised of the rear end of the bottom wall 11, and a pair of crimping pieces 16 at the rear ends of the side walls 12. The crimping pieces 16 are offset longitudinally from each other, and are crimped into connection with the wire W supplied between the side walls 12. The crimping step may be performed simultaneously with, before or after a step of insulation displacement described below.

The insulation-displacement portions 17 are arranged to define front and rear pairs of insulation-displacement portions 17. Thus, a total of four insulation-displacement portions 17 are provided. The insulation-displacement portions 17 in each pair comprise a first insulation-displacement portion 17 on the first side wall 12 and a second insulation-displacement portion 17 on the second side wall 12. Additionally, the insulation-displacement portions 17 in each pair are spaced apart transversely a sufficient distance to engage the core Wb of the wire W therebetween.

Each insulation-displacement portion 17 is formed by embossing the corresponding side wall 12 to project into the wire-receiving space. More specifically, each insulation-displacement portion 17 comprises a pair of bases 18 and a blade 19. The bases 18 of each insulation-displacement portion 17 project into the wire-receiving space from the side wall 12 and converge substantially in a V-shape when viewed from above, or along the direction in which the wire W is pushed into the wire-receiving space. However, the projecting ends of the bases 18 are not connected with each other directly. The blade 19 is formed from two blade panels that are folded from the respective projecting ends of the bases 18 to project still further into the wire-receiving space between the side walls 12.

Each blade 19 projects in an I-shape from the projecting ends of the bases 18 in a direction normal to the respective side wall 12 when viewed in the wire pushing direction. The four insulation-displacement portions 17 thus formed are symmetrical along forward and backward directions. Additionally, the first and second insulation-displacement portions 17 in each opposed pair are shaped and arranged symmetrically about a transverse axis.

Projecting ends of the blades 19 on a transverse pair of the insulation-displacement portions 17 are spaced apart by a distance Sb, which is slightly smaller than the outer diameter of a core Wb of the wire W. Additionally, ends of the blades 19 adjacent the respective bases 18 are spaced apart a distance Sa, which is equal to or slightly larger than the outer diameter of a resin coating Wa of the wire W.

The wire W is oriented with its axis parallel to the longitudinal direction of the terminal fitting T, and is pushed transversely into the wire receiving space between the side walls 12 of the insulation-displacement terminal fitting T. The pushing forces cause the blades 19 to cut open the resin coating Wa of the wire W between the respective pairs of the transversely arranged insulation-displacement portions 17. Thus, the blades 19 bite into the cut-open sections of the resin coating Wa and contact the core Wb. In this way, the wire W is connected with the insulation-displacement portions 17 by insulation displacement.

The blades 19 are made narrower than the V-shaped bases 18 by folding. Thus, the blades 19 contact the resin coating Wa much like a single unitary blade when the wire W is pushed between the insulation-displacement portions 17. The ability of each folded blade 19 to function substantially as a single unfolded blade is facilitated by the alignment of the chamfers on the tops of the blades 19. More particularly, the upper chamfer edges of the folded panels of each blade 19 are substantially adjacent, and the lower chamfer edges are spaced apart. Thus, the chamfers on each folded blade 19 taper upwardly and toward one another. As a result, the resin coating Wa can be cut open smoothly and securely. Further, the resin coating Wa is brought into contact with the narrow blades 19, but not with the bases 18. Consequently, there is no possibility of an erroneous insulation displacement resulting from the resin coating Wa getting hooked by the wider bases 18.

A pushing or pulling force may act on the wire W in its longitudinal direction after the wire W is connected by insulation displacement. However, deformations of the insulation-displacement portions 17 in the longitudinal direction of the wire W are restricted securely, because base ends 18A of the bases 18 are continuous with the side walls 12 in two spaced-apart positions along the longitudinal direction of the wire W and because the bases 18 are triangular. Therefore, a loose movement of the wire W in its longitudinal direction can be securely prevented.

Figure 5:
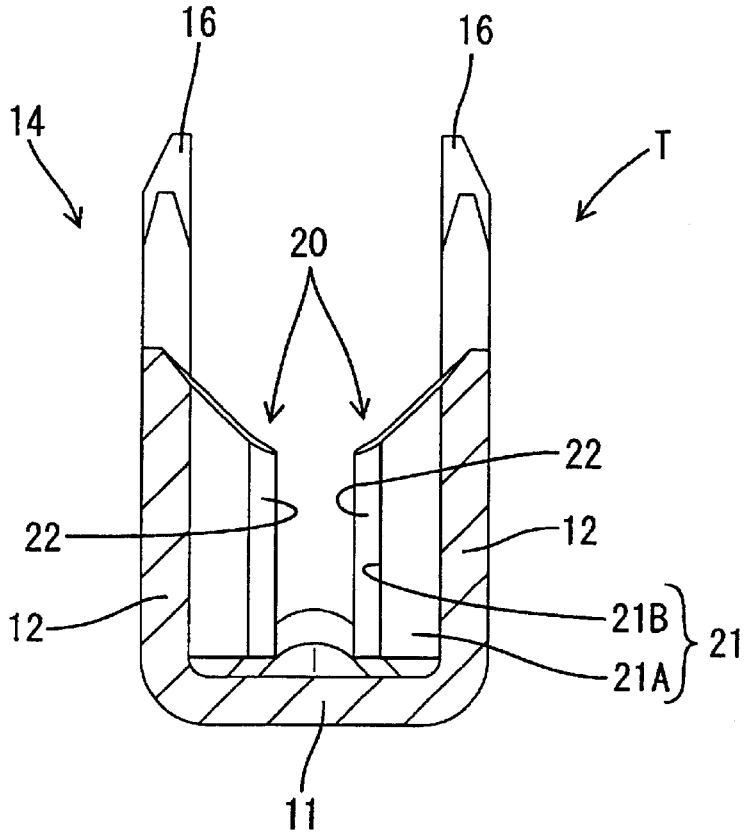
FIGS. 5(A) and 5(B) are an enlarged lateral section and an enlarged partial plan view showing insulation-displacement portions of a second embodiment, respectively.
Figure 5:
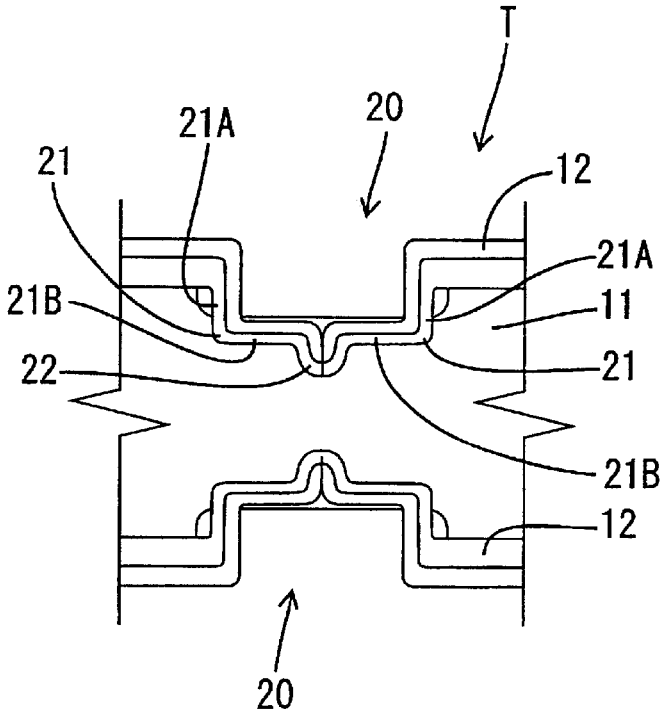

A second embodiment of the invention is described with reference to FIG. 5. Insulation-displacement portions 20 of the second embodiment differ from those of the first embodiment in their construction. Other elements of the second embodiment are the same as in the first embodiment. Accordingly, no description is given on the structure, action and effects of these similar elements, and they merely are identified by the same reference numerals as in the description of the first embodiment.

Each insulation-displacement portion 20 of the second embodiment has two bases 21 that are L-shaped when viewed in the wire pushing direction shown in FIG. 5(B) and a blade 22 that extends in a direction normal to the side wall 12. Each L-shaped base 21 has a base section 21A and a leading section 21B. Each base section 21A extends unitarily from the respective side wall 12 at a right angle. The leading sections 21B of each respective base 21 extend parallel with the side wall 12 and are substantially coplanar with each other. However the leading sections 21B of each base 21 are slightly spaced from one another.

Figure 6:
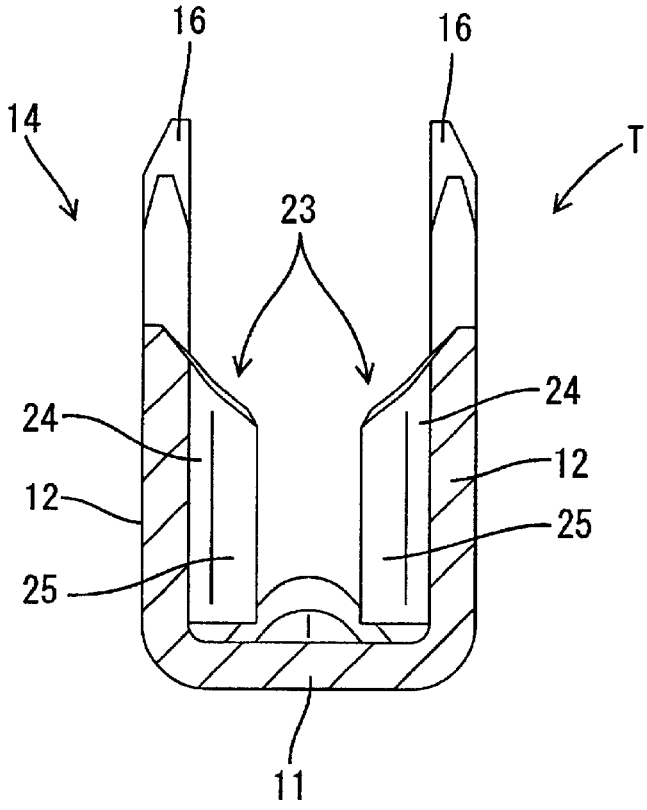
FIGS. 6(A) and 6(B) are an enlarged lateral section and an enlarged partial plan view showing insulation-displacement portions of a third embodiment, respectively.
Figure 6:
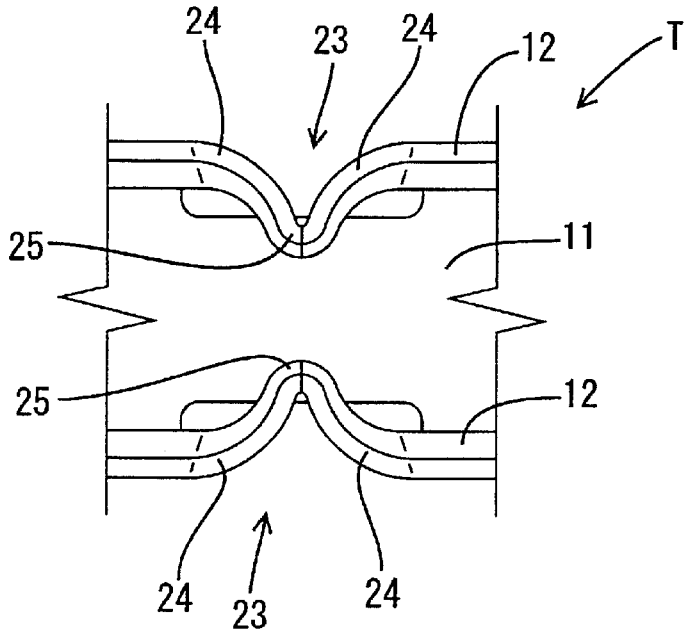

A third embodiment of the invention is illustrated with reference to FIG. 6. Insulation-displacement portions 23 of the third embodiment differ from those of the first embodiment in their construction. However the other construction of the third embodiment is substantially the same as in the first embodiment. Therefore, no description is given on the structure, action and effects of those identical elements, and they are identified merely by employing the same reference numerals as the first embodiment.

Each insulation-displacement portion 23 of the third embodiment has bases 24 that are in the form of substantially quarter-circular or quarter-cylindrical arcs when viewed in the wire pushing direction, and a blade 25 that extends in a direction normal to the side wall 12. The bases 24 are in the form of arcs with concave surfaces facing into the wire-receiving space. Thus the bases 24 bulge toward each other. Base ends of the bases 24 are smoothly tangent to the side wall 12, and the leading ends thereof are smoothly tangent to the blade 25.

Figure 7:
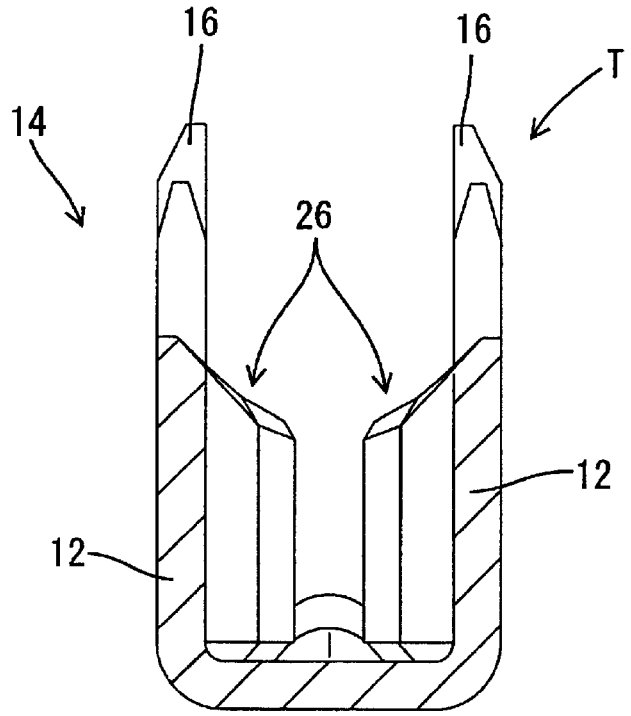
FIGS. 7(A) and 7(B) are an enlarged lateral section and an enlarged partial plan view showing insulation-displacement portions of a fourth embodiment, respectively.
Figure 7:
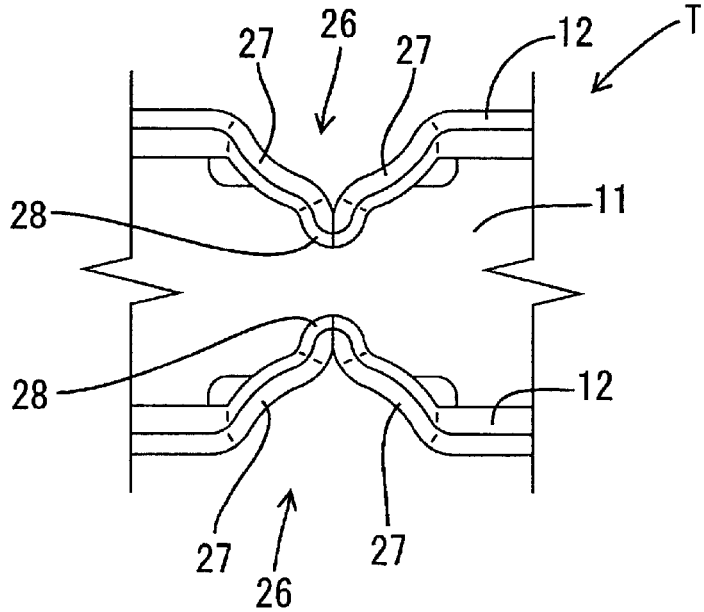

A fourth embodiment of the invention is illustrated in FIG. 7. Insulation-displacement portions 26 of the fourth embodiment differ from those of the first embodiment. However, the other construction is same as in the first embodiment. As a result, no description is given on the structure, action and effects of these identical elements, and they are identified merely by employing the same reference numerals as the first embodiment.

Each insulation-displacement portion 26 of the fourth embodiment is similar to the third embodiment in that the bases 27 are substantially quarter-circular or quarter-cylindrical arcs when viewed in the wire pushing direction, and in that a blade 28 extends in a direction normal to the side wall 12. The bases 27 are in the form of arcs with convex surfaces bulging into the wire-receiving space and concave surfaces facing each other. Base ends of the bases 24 are continuous with and at an angle to the side wall 12 while the leading ends thereof are continuous with and at an angle to the blade 25.

The present invention is not limited to the above described and illustrated embodiments. For example, the following embodiments are also embraced by the technical scope of the present invention. Beside the following embodiments, various changes can be made without departing the sprit of the present invention.

Each pair of bases is symmetrically shaped along the longitudinal direction of the wire in the foregoing embodiments. However, the bases may be asymmetrically shaped along the longitudinal direction of the wire.

Each pair of bases is identical in shape and symmetrically arranged along the longitudinal direction of the wire in the foregoing embodiments. However, the bases may have different shapes when viewed in the wire pushing direction. For example, one base may be similar to the first embodiment while the other base may be similar to any of the second to fourth embodiments.

The folded blades and the projecting ends of the bases are continuous with each other in the foregoing embodiments. However, the projecting ends of a pair of plates that form the blade may be spaced apart and the two plates may be continuous with separate bases. Alternatively, a blade formed by folding may be continuous with one base while being spaced apart from the other base according to the present invention.

The dimensions of the insulation-displacement portions are set such that only the blades of the insulation-displacement portions bite into the coating in the foregoing embodiments. However, the dimensions may be set such that both the entire blades and the projecting ends of the bases bite in the coating when the wire is connected by insulation displacement. In such a case, both the blades and the bases receive a pushing or pulling force on the wire in its longitudinal direction. Therefore, loose movement of the wire in its longitudinal is restricted more reliably.

What is claimed is:

1. An insulation-displacement terminal fitting (T), comprising: an elongate bottom wall (11), first and second opposed side walls (12) extending up from the bottom wall (11) and defining a wire-receiving space therebetween, first and second insulation-displacement portions (16; 20; 23; 26) projecting inwardly from the respective side walls (12) and into the wire-receiving space, each said insulation-displacement portion (16; 20; 23; 26) comprising first and second bases (18; 21; 24; 27) formed unitarily with the respective side wall (12) and being spaced apart longitudinally, each said insulation-displacement portion (16; 20; 23; 26) further comprising a blade (19; 22; 25; 28) having first and second blade panels folded further into the wire receiving space from ends of the respective first and second bases (18; 21; 24; 27) most distant from the respective side wall (12).

2. The insulation-displacement terminal fitting (T) of claim 1, wherein the bases (18; 21; 24; 27) of each insulation-displacement portion (16; 20; 23; 26) are spaced from one another at all locations thereon.

3. The insulation-displacement terminal fitting (T) of claim 1, wherein the bases (18; 21; 24; 27) of each insulation-displacement portion (16; 20; 23; 26) converge toward one another at locations further from the respective side wall (12).

4. The insulation-displacement terminal fitting (T) of claim 1, wherein the insulation-displacement terminal fitting (T) is used with a wire (W) having a core (Wa) with a selected diameter and a resin coating (Wb) surrounding the core (Wa), the blades (19; 22; 25; 28) of the first and second insulation-displacement portions (16; 20; 23; 26) being spaced apart by a distance no greater than the diameter of the core (Wa) of the wire (W).

5. The insulation-displacement terminal fitting (T) of claim 4, wherein the bases (18; 21; 24; 27) of the respective first and second insulation-displacement portions (16; 20; 23; 26) are spaced apart by a distance greater than the diameter of the core (Wa) of the wire (W).

6. The insulation-displacement terminal fitting (T) of claim 1, wherein at least one said base (18; 21) comprises a planar portion aligned to the respective side wall (12) at a base angle.

7. The insulation-displacement terminal fitting (T) of claim 6, wherein the base angle is an acute angle.

8. The insulation-displacement terminal fitting (T) of claim 6, wherein the base angle is a right angle.

9. The insulation-displacement terminal fitting (T) of claim 1, wherein at least one said base (24; 27) is arcuate.

10. The insulation-displacement terminal fitting (T) of claim 9, wherein the arcuate base (18; 21) includes a convex surface facing into the wire-receiving space.

11. The insulation-displacement terminal fitting (T) of claim 9, wherein the arcuate base (18; 21) includes a concave surface facing into the wire-receiving space.

12. The insulation-displacement terminal fitting (T) of claim 9, wherein the arcuate base (18; 21) defines a quarter of a cylinder.

13. An insulation-displacement terminal fitting (T) for use with a wire (W) having a core (Wa) with an outside diameter, the wire (W) further having an insulating coating (Wb) surrounding the core (Wa), the insulation-displacement terminal fitting (T) comprising: an elongate bottom wall (11), first and second opposed side walls (12) extending up from the bottom wall (11) and defining a wire-receiving space therebetween, first and second opposed insulation-displacement portions (16; 20; 23; 26) projecting inwardly from the respective side walls (12) and into the wire-receiving space, each said insulation-displacement portion (16; 20; 23; 26) comprising first and second bases (18; 21; 24; 27) formed unitarily with the respective side wall (12) and converging toward one another from spaced apart locations along the respective side wall (12), each said insulation-displacement portion (16; 20; 23; 26) further comprising a blade (19; 22; 25; 28) having first and second blade panels folded further into the wire receiving space from ends of the respective first and second bases (18; 21; 24; 27) most distant from the respective side wall (12), the blades (19; 22; 25; 28) on the opposed first and second insulation-displacement portions (16; 20; 23; 26) being spaced from one another by a distance less than the diameter of the core (Wa), the bases (18; 21; 24; 27) of the first insulation-displacement portion (16; 20; 23; 26) being spaced from the bases (18; 21; 24; 27) of the second insulation-displacement portion (16; 20; 25; 28) by a distance not less than the diameter of the core (Wa).

14. The insulation-displacement terminal fitting (T) of claim 13, wherein at least one said base (18; 21) comprises a planar portion aligned to the respective side wall (12) at a base angle.

15. The insulation-displacement terminal fitting (T) of claim 14, wherein the base angle is an acute angle.

16. The insulation-displacement terminal fitting (T) of claim 14, wherein the base angle is a right angle.

17. The insulation-displacement terminal fitting (T) of claim 13, wherein at least one said base (24; 27) is arcuate.

18. The insulation-displacement terminal fitting (T) of claim 17, wherein the arcuate base (18; 21) includes a convex surface facing into the wire-receiving space.

19. The insulation-displacement terminal fitting (T) of claim 17, wherein the arcuate base (18; 21) includes a concave surface facing into the wire-receiving space.

* * * * *